United States Patent [19]

Harrison et al.

[11] 4,390,017

[45] Jun. 28, 1983

[54] ENTERAL FEEDING SYSTEM

[76] Inventors: Eugene O. Harrison, 1372 Fairview Rd., NE., Atlanta, Ga. 30306; David J. Martin, 3531 Tewksbury Dr., Snellville, Ga. 30278; Martin L. Olson, 340 Blvd., NE, Atlanta, Ga. 30312

[21] Appl. No.: 290,820

[22] Filed: Aug. 7, 1981

[51] Int. Cl.[3] ..... A61J 7/00

[52] U.S. Cl. ..... 604/270; 604/275; 604/283

[58] Field of Search ..... 128/349 R, 350 R, 222, 128/247, 348, 240, 246, 224

[56] References Cited

U.S. PATENT DOCUMENTS

| | | | |
|---|---|---|---|
| 2,492,384 | 12/1949 | Kaslow | 128/350 R |
| 3,144,868 | 8/1964 | Jascalevich | 128/350 R |
| 3,155,097 | 11/1964 | Barron | 128/350 R |
| 3,395,710 | 8/1968 | Stratton et al. | 128/350 R |
| 4,249,535 | 2/1981 | Hargest | 128/222 X |

*Primary Examiner*—John D. Yasko

*Attorney, Agent, or Firm*—Newton, Hopkins & Ormsby

[57] ABSTRACT

A safer, more comfortable and convenient enteral feeding system is disclosed. Features of the system include reversal of the male-female connections on a standard enteral feeding system, and a safety pressure relief on the male adapter of the feeding tube assembly. A double female-ended guide wire adapter enables accurate placement of the feeding tube in a patient with lubrication of the passage which is receiving the tube. The provision of male and female double-ended adapter tubes allows utilization of the invention with other standard feeding systems.

10 Claims, 6 Drawing Figures

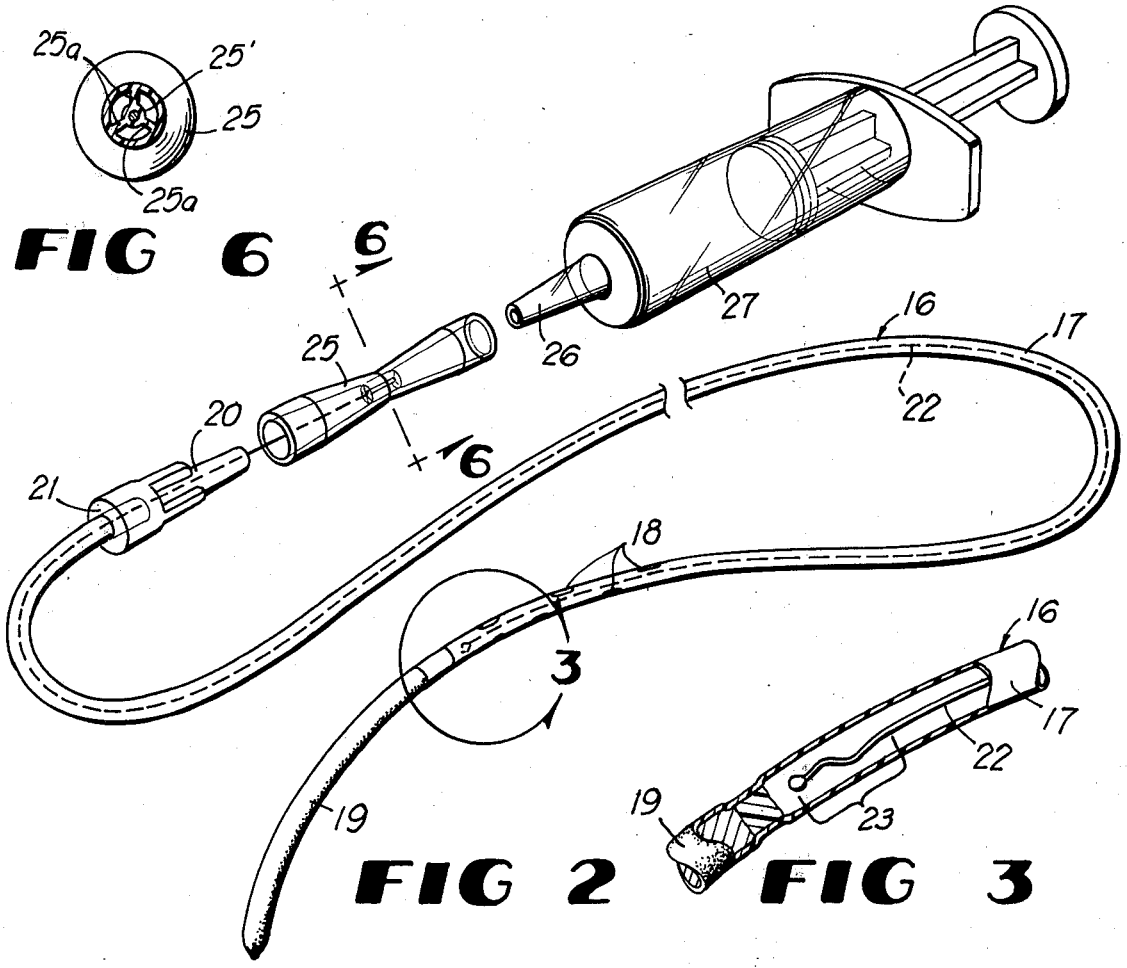
FIG 6
FIG 2
FIG 3
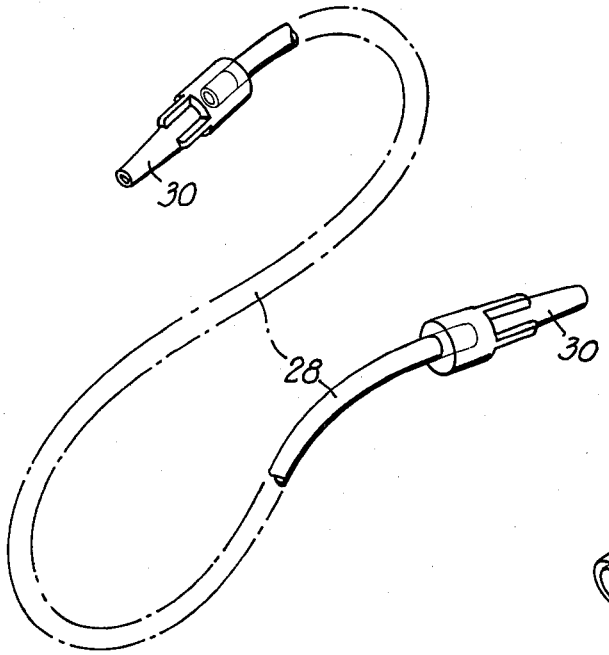
FIG 4
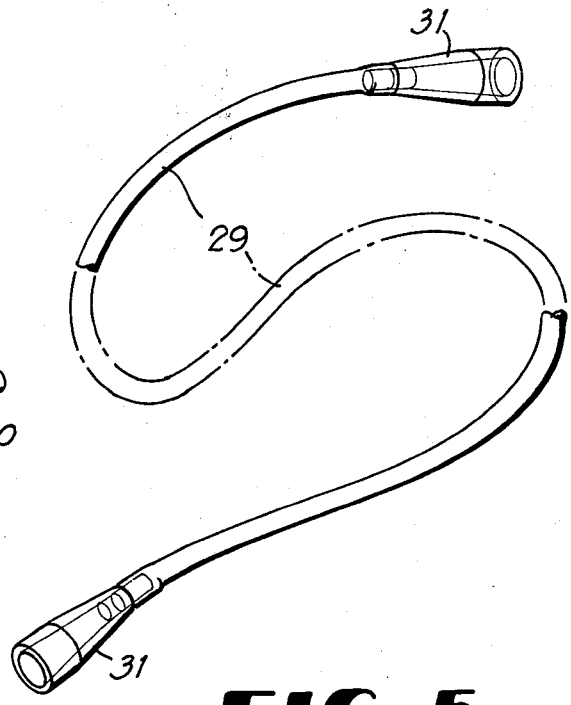
FIG 5

ENTERAL FEEDING SYSTEM

BACKGROUND OF THE INVENTION

Enteral feeding systems are widely used in hospitals and nursing homes to nourish patients with a variety of afflictions. Standard commercial feeding systems, while able to serve their intended purpose, possess certain drawbacks and inconveniences which the present invention seeks to cure. Among the drawbacks of the prior art in some cases is the possibility of inadvertently connecting the enteral feeding system with an intravenous system or tube. This hazard has been eliminated with the construction of the present application. Another drawback of the prior art is that the components, such as the feeding tubes of one standard system, are not compatible and usable in another system. This incompatibility has been eliminated in the invention, allowing maximum utilization of the system and maximum cost effectiveness.

A main objective of the invention is to provide an enteral feeding system that embodies reversal of the standard male/female connections of an intravenous system so as to prevent any chance of interchangeability.

Additionally, an object of the invention is to provide a readily removable guide wire assembly for an enteral feeding tube having an attached double-ended female adapter which enables the use of the guide wire with an irrigating and lubricating syringe to place the feeding tube in a patient requiring it with greater comfort and precision.

Another important object is to provide a safety pressure relief means on the feeding tube assembly which will relieve pressure at about 40 psi.

Another object is to provide a highly flexible end terminal on the guide wire to facilitate comfortable and safe guidance of the tube assembly into the patient.

Other features and advantages of the invention will become apparent during the course of the following detailed description.

BRIEF DESCRIPTION OF THE DRAWINGS

FIG. 2 is a similar view of an irrigation assembly for the feeding tube.

FIG. 3 is an enlarged inset view taken at circle 3 in FIG. 2 partially sectioned showing a flexible terminal on a guide wire.

FIGS. 4 and 5 are fragmentary perspective views of adapter tubes equipped with end male and female fittings.

FIG. 6 is an enlarged transverse section taken on line 6—6 of FIG. 2.

DETAILED DESCRIPTION

Figure 1:
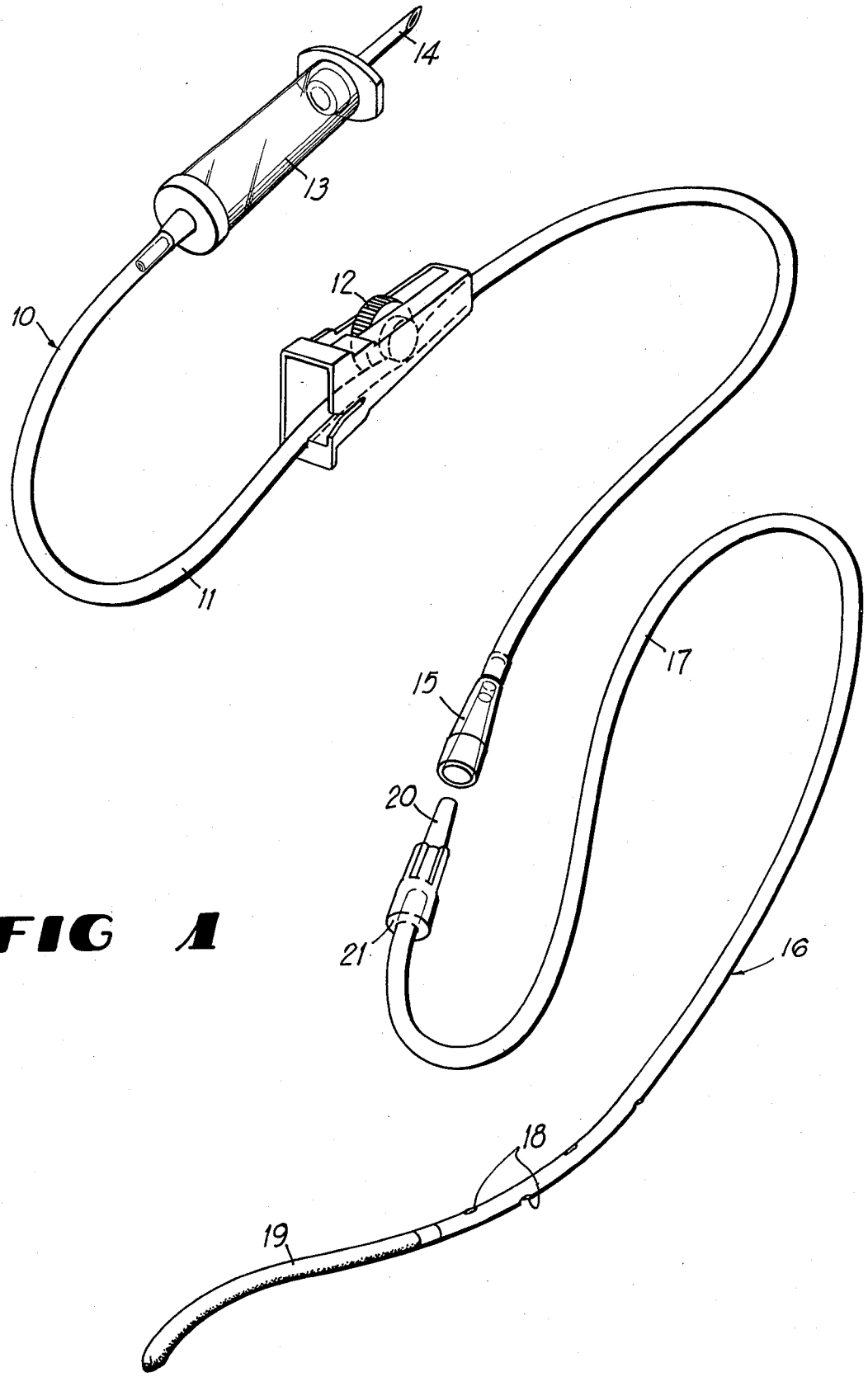
FIG. 1 is a partly exploded perspective view of an improved enteral feeding system according to the invention.

Referring to the drawings in detail wherein like numerals designate like parts, an administration set or assembly 10 comprises a flexible tube 11 having mounted thereon a conventional roller clamp 12. A drip chamber 13 having a spike 14 is carried by one end of the tube 11 for ready connection with a source container, not shown. The other end of the tube 11 carries a conical female adapter or fitting 15.

A feeding tube assembly 16, according to the invention, comprises a flexible feeding tube body 17 having outlet perforations 18 near its lower end. Beyond these perforations, a mercury weighted flexible terminal 19 is provided on the lower end of the feeding tube assembly. The upper end of the assembly 16 carries a male adapter 20 or fitting readily connectable with the female fitting 15 of the administration set. The male adapter 20 possesses a safety pressure relief feature in that its end wall 12 will rupture to relieve pressure in the tube assembly 16 at approximately 40 psi.

The feeding tube assembly 16, FIG. 2, can receive a readily removable semi-rigid internal guide wire 22 within the tube body 17 to facilitate guiding the feeding tube assembly into a patient. The guide wire 22 has an attached double-ended female adapter 25 for connecting the male adapter 20 of the feeding tube with the tapered nozzle 26 of a standard irrigation syringe 27. The double-ended adapter 25 at its center throat has an interal hub 25' fixed therein including spaced radial arms **25*a* between which irrigating or lubricating fluid from the syringe may flow into the tube body 17. One end of the semi-rigid guide wire 22 is permanently fixed to the center of the hub 25'**.

When the feeding tube assembly 16 is being inserted into a patient, the guide wire 22 is installed in the tube body 17 temporarily, and one end of the double-ended fitting 25 is coupled to the male fitting 20. The wire 22 will then extend nearly to the weighted terminal 19, as shown in FIG. 2. The syringe nozzle 26 is then coupled to the other end of fitting 25 and fluid from the syringe is used to lubricate the passage through which the feeding tube assembly is being installed, considerably lessening patient discomfort.

Additionally, the arrangement makes it possible to determine with precision the location of the feeding tube in the patient. A stethoscope can be used to detect fluid from the syringe 27 gurgling through the apertures 18 near the bottom of the feeding tube assembly. In some cases, the syringe can inject air rather than a liquid through the assembly 16.

Once the installation of the feeding tube assembly 16 has been accomplished, the guide wire 22 and adapter 25 are separated from the assembly 16 and the administration set 10 can be coupled with the male fitting 20 to enable the feeding of the patient from a regular source container.

Approximately a final one-quarter inch section 23 of the guide wire 22 is made highly flexible and yielding to promote comfort and avoid injury when the feeding tube assembly is being guided into the patient.

Another feature of the feeding system is the provision of a pair of separate adapter tubes 28 and 29, FIGS. 4 and 5, one having a pair of opposite end male adapters or connectors 30 and the other having opposite end female adapters 31. These adapter tubes allow utilization of the invention with other standard commercial feeding systems regardless of whether the latter have male or female connectors or particular components.

It is thought that the several advantages of the invention over the prior art should now be apparent to those skilled in the art without the necessity for further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An enteral feeding system comprising a feeding tube assembly having a feeding tube body containing perforations near one end thereof and having a tapered connector element on its other end adapted for coupling with a mating connector element of an administration set, and said feeding tube assembly removably receiving therein a semi-rigid guide wire having an attached double-ended tapered adapter which can be coupled with said tapered connector element and with the nozzle of an irrigation syringe.

2. An enteral feeding system as defined in claim 1, and said tapered connector element comprising a male element, and said double-ended tapered adapter comprising a double-ended female adapter to receive in one end the tapered connector element and in its other end said nozzle.

3. An enteral feeding system as defined in claim 1, and a mercury weighted flexible terminal on the feeding tube assembly remote from the tapered connector element and extending longitudinally beyond the region of said perforations.

4. An enteral feeding system as defined in claim 1, and the semi-rigid guide wire having a short highly flexible terminal end portion thereon remote from the tapered connector element.

5. An enteral feeding system as defined in claim 1, and an administration set separate from the feeding tube assembly and having a tapered connector element on one end thereof adapted to interfit with the tapered connector element of the feeding tube assembly, the administration set including a drip chamber having a spike at its end away from the tapered connector element of the administration set and further including a roller clamp to regulate flow through the administration set.

6. An enteral feeding system as defined in claim 1, and a pair of separate adapter tubes one having a pair of opposite end male tapered connector elements and the other having a pair of opposite end female connector elements whereby the feeding tube assembly is rendered adaptable with standard enteric feeding systems.

7. An enteral feeding system as defined in claim 2, and said double-ended female adapter comprising in its throat portion a fixed hub to which one end of said guide wire is attached centrally, and the hub having spaced radiating arms between which fluid from said syringe may flow.

8. In an enteral feeding system, a feeding tube assembly including a feeding tube body having perforations near one end thereof and having a tapered male connector element on the other end thereof away from the perforations, an administration set separate from the feeding tube assembly and having a tapered female connector element on one end thereof adapted to interfit with the tapered male connector element of the feeding tube assembly, and said male and female tapered connector elements by their respective positioning on said feeding tube body and said administration set preventing any interchangeability of these components with those of an intravenous feeding system.

9. In an enteral feeding system as defined in claim 8, and a guide wire to assist in inserting the feeding tube assembly into a patient and adapted to enter the bore of the feeding tube body removably and having on one end a permanently attached double-ended female adapter which may be coupled temporarily with said tapered male connector element and the tapered nozzle of a fluid syringe.

10. In an enteral feeding system as defined in claim 8, and a mercury weighted flexible terminal on the feeding tube assembly remote from the tapered connector element and extending beyond the region of said perforations.

* * * * *